US006719035B1

(12) United States Patent
Takayama et al.

(10) Patent No.: US 6,719,035 B1
(45) **Date of Patent: *Apr. 13, 2004**

(54) METHOD AND APPARATUS FOR INJECTION MOLDING METAL MATERIAL

(75) Inventors: Kazutoshi Takayama, Nagano-ken (JP); Toshiyasu Koda, Nagano-ken (JP); Yasuhiko Takeuchi, Nagano-ken (JP); Yuji Hayashi, Nagano-ken (JP)

(73) Assignee: Nissei Plastic Industrial Co., Ltd., Nagano-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/672,388

(22) Filed: Sep. 28, 2000

(30) Foreign Application Priority Data

Sep. 30, 1999 (JP) ..... 11-279373

(51) Int. Cl.[7] ..... B22D 17/00
(52) U.S. Cl. ..... 164/113; 164/312
(58) Field of Search ..... 164/113, 303, 164/312, 316, 317, 900, 150.1

(56) References Cited

U.S. PATENT DOCUMENTS 5,040,589 A * 8/1991 Bradley et al. ..... 164/113
5,143,736 A * 9/1992 Kumamura et al. ..... 425/567
5,501,266 A * 3/1996 Wang et al. ..... 164/113
5,601,136 A * 2/1997 Shimmell ..... 164/312
5,910,328 A * 6/1999 Oshiro et al. ..... 425/595
5,983,976 A * 11/1999 Kono ..... 164/113
6,588,486 B1 * 7/2003 Takayama et al. ..... 164/113
6,640,875 B1 * 11/2003 Kobayashi et al. ..... 164/113

FOREIGN PATENT DOCUMENTS

JP 9-108805 * 4/1997 ..... B22D/17/00
WO WO 97/21509 * 6/1997 ..... B22D/17/00

* cited by examiner

*Primary Examiner*—M. Alexandra Elve
*Assistant Examiner*—Kevin Kerns
(74) *Attorney, Agent, or Firm*—Weingarten, Schurgin, Gagnebin & Lebovici LLP

(57) ABSTRACT

An injection molding apparatus of a metal material places a heating cylinder in an inclined position. The heating cylinder includes a nozzle at a tip thereof and a screw disposed inside. In this way, the metal material in a liquid phase state can be transferred and metered accurately in a reliable manner at all times by flowing due to the inclination and a transfer force produced by rotation of the screw. A clamping apparatus is provided to oppose the injection apparatus and includes a mold having a sprue bush inside. The injection apparatus and the clamping apparatus are placed on an apparatus platform in an inclined position at the same angle with the mold in a lower end, so that the metal material in the liquid phase state in the heating cylinder flows down toward the head due to self-weight. The nozzle and sprue bush are positioned on the same straight line, thereby maintaining nozzle touch without bending the nozzle.

4 Claims, 3 Drawing Sheets

METHOD AND APPARATUS FOR INJECTION MOLDING METAL MATERIAL

BACKGROUND OF THE INVENTION

1. Field of the Invention

The present invention relates to a method and an apparatus for injection molding a metal material, and more particularly to a method and an apparatus for injection molding a metal material, by which nonferrous metal having a low melting point, such as zinc, magnesium, or alloy thereof, is completely melted to allow injection molding in a liquid phase state.

2. Detailed Description of the Prior Art

Attempts have been made to completely melt nonferrous metal having a low melting point so as to allow injection molding in a liquid phase state. Like in the case of injection molding of a plastic material, the molding method thereof adopts a heating cylinder having inside an injecting screw, which is allowed to rotate and move along the axial direction. A granular metal material supplied from the rear portion of the heating cylinder is heated and melted completely while being transferred toward the head of the heating cylinder by means of rotation of the screw, and after a quantity of the metal material in the liquid phase state is metered in the front chamber of the heating cylinder, the metal material is injected to fill a mold through the nozzle attached to the tip of the heating cylinder by moving the screw forward.

A problem occurring in case of adopting the foregoing injection molding for the metal material is that the material is neither transferred readily nor metered in a stable manner by means of rotation of the screw.

A molten plastic material has a high viscosity, and transfer of the molten plastic material by means of rotation of the screw is allowed mainly because a friction coefficient at the interface of the molten plastic material and the screw is smaller than a friction coefficient at the interface of the molten plastic material and the inner wall of the heating cylinder, and therefore, a difference in friction coefficient is produced between the two interfaces.

In contrast, the metal material, when melted completely to the liquid phase state, has such a low viscosity compared with the plastic material that a difference in friction coefficient is hardly produced between the above two interfaces. Hence, a transfer force such as the one produced with the molten plastic material by means of rotation of the screw is not readily produced.

However, a transfer force is produced with the metal material when it is in a solid state and in a high viscous region where the metal material is in a semi-molten state during the melting process. Thus, the metal material can be transferred by means of rotation of the screw up to that region. Nevertheless, as the metal material is further melted, the viscosity drops with an increasing ratio of the liquid phase, and the transfer force produced by the screw grooves between the adjacent screw flights decreases, thereby making it difficult to supply the molten metal material in a stable manner to the front chamber of the heating cylinder by means of rotation of the screw.

Because the molten plastic material has a high viscosity, it is stored in the front chamber of the heating cylinder by means of rotation of the screw, while at the same time, a material pressure that pushes the screw backward is produced as a reaction. By controlling the screw retraction caused by the material pressure, a constant quantity of the molten material can be metered each time.

However, the metal material in the low-viscous liquid phase state cannot produce a pressure high enough to push the screw backward. Thus, the screw retraction by the material pressure hardly occurs, and if the metal material is stored in the front chamber by means of rotation of the screw alone, a quantity thereof undesirably varies, thereby making it impossible to meter a constant quantity each time.

In addition, the metal material has a far larger specific gravity compared with the plastic material, and has a low viscosity and fluidity in the liquid phase state. For this reason, when allowed to stand by stopping rotation of the screw, the metal material in the liquid phase state in the heating cylinder placed in a horizontal position leaks into the semi-molten region in the rear portion through a clearance formed between the screw flights and heating cylinder. Consequently, the metal material accumulated in the front chamber causes a back flow onto the periphery of the head portion of the screw through the opened ring valve, and the quantity thereof is undesirably reduced.

The liquid level in the front chamber is lowered with the decreasing accumulation quantity. For this reason, a gaseous phase (space) that makes the metering unstable is generated at the upper portion of the front chamber. In addition, the leaked metal material in the liquid phase state increases its viscosity in the semi-molten region as its temperature drops, or turns into solid depending on the heating condition in the semi-molten region, thereby forming weirs in the screw grooves. This poses a problem that the granular material supplied from the supply port provided behind the weirs cannot be transferred readily by means of rotation of the screw.

SUMMARY OF THE INVENTION

The present invention is devised to solve the above problems raised with injection molding of a metal material in the liquid phase state, and therefore, has an object to provide a novel method and apparatus for injection molding a metal material, by which the metal material in the liquid phase state can be transferred, metered, and deaerated smoothly at all times by adopting means of placing an injection apparatus in an inclined position.

In order to achieve the above and other objects, the present invention provides an injection molding apparatus of a metal material composed of an injection apparatus having a heating cylinder provided with a nozzle at a tip thereof and a supply port at a rear portion thereof and having inside a screw, which is allowed to rotate and move along an axial direction, and a clamping apparatus provided to oppose the injection apparatus and equipped with a mold having inside a sprue bush, in which the injection apparatus and clamping apparatus are placed on an apparatus platform in an inclined position at a same angle with the mold in a lower end, so that the metal material in a liquid phase state in the heating cylinder flows down into a front chamber of the heating cylinder due to self-weight, and that the nozzle and the sprue bush inside the mold are positioned on a same straight line, thereby maintaining nozzle touch without bending the nozzle.

The screw may include an injecting plunger at the tip thereof. The plunger has substantially a same diameter as a diameter of the front chamber formed in the heating cylinder at a top end portion by reducing a diameter thereof so as to be allowed to fit into the front chamber by moving forward and backward while securing a sliding clearance such that hardly causes a back flow of a liquid phase material accumulated in the front chamber.

Further, the present invention provides an injection molding method of a metal material including: placing both (1) an injection apparatus having a heating cylinder provided with a nozzle at a tip thereof and a supply port at a rear portion thereof and having inside a screw, which is allowed to rotate and move along an axial direction, and (2) a mold provided to oppose the injection apparatus and having inside a sprue bush in an inclined position at a same angle with the mold in a lower end, so that a metal material in a liquid phase state in the heating cylinder flows down into a front chamber of the heating cylinder due to self-weight; accumulating and metering the metal material in the liquid phase state in the front chamber of the heating cylinder by means of flowing due to an inclination and rotation of the screw; and injecting the metal material to fill the mold.

In the present invention, it is preferable to provide a sensor for counting the number of revolutions of the screw, so that the number of revolutions of the screw is controlled to stay at a set number of revolutions by means of the sensor.

As has been discussed, according to the present invention, by placing both the injection apparatus and mold in an inclined position at the same angle, the metal material in the liquid phase state can be accumulated and metered in the front chamber by means of flowing due to an inclination and rotation of the screw. Therefore, even when the metal material is in the low-viscous liquid phase state, the metal material can be transferred readily and smoothly by the screw. In addition, the liquid surface faces a gaseous phase produced at the interface between a semi-molten material and the liquid phase material in a horizontal position, and the semi-molten material is positioned upper than the liquid surface. For this reason, even when allowed to stand by stopping the rotation of the screw, the liquid phase material does not leak into the semi-molten material side, thereby preventing unwanted variance in an accumulation quantity in the front chamber. Further, the metal material in the liquid phase state can be stored primarily and an accumulation quantity in the front chamber can be compensated by means of rotation of the screw. Consequently, a product with a stable molding state can be obtained from a metal material even by means of injection molding of a metal material in the liquid phase state.

Also, because the injection apparatus and mold are placed on the apparatus platform in an inclined position at the same angle with the mold at the lower end so that the nozzle and the sprue bush inside the mold are positioned on the same straight line to maintain the nozzle touch without bending the nozzle, the moving direction of the nozzle and the opening/closing direction of the mold have a common axis. Consequently, the tip end surface of the nozzle and the nozzle touch surface of the sprue bush can be formed in the typical manner, while at the same time, leaking of the material caused often by deficient nozzle touch can be prevented.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The following description will describe the present invention in detail with reference to the accompanying drawings.

Figure 1:
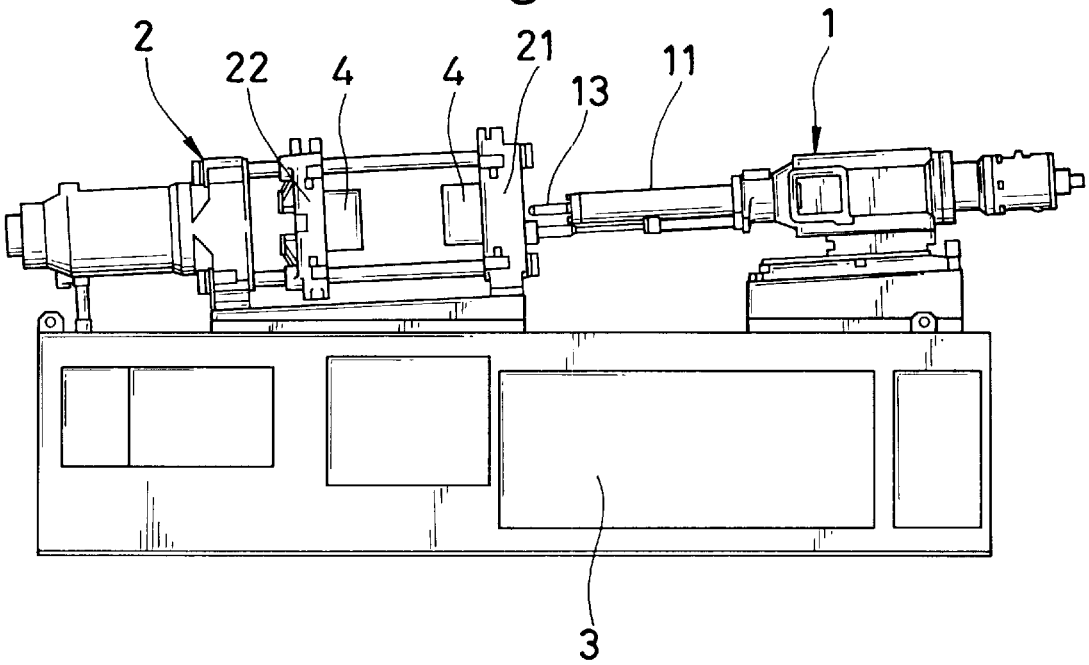
FIG. 1 is an elevation of an injection molding apparatus of a metal material according to the present invention.

FIG. 1 shows one example of an injection molding apparatus employed in the present invention. In the drawing, reference numeral 1 denotes an in-line screw type injection apparatus, and reference numeral 2 denotes a clamping apparatus of a typical known type provided to oppose the injection apparatus 1. Also, a pair of split type molds 4 are provided to a stationary platen 21 and a movable platen 22 of the clamping apparatus 2, respectively.

Figure 2:
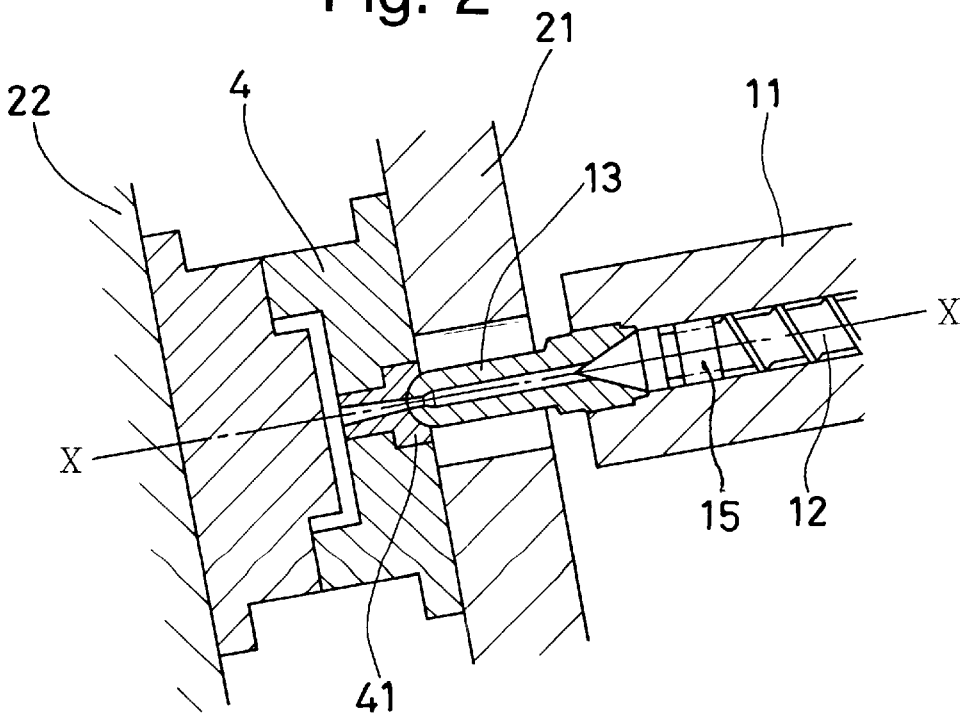
FIG. 2 is a fragmentary longitudinal section showing a nozzle touch state between a nozzle and a sprue bush according to the present invention.

As schematically shown in FIG. 2, the injection apparatus 1 includes a heating cylinder 11. Band heaters (not shown in the drawing) are attached at regular intervals on its outer periphery. An injecting screw 12 is housed in the heating cylinder 11 in such a manner so as to be allowed to rotate and move along the axial direction. The heating cylinder 11 also has a nozzle 13 at the tip thereof and a supply port 14 of a granular metal material at the rear portion thereof (See FIG. 3). The heating cylinder 11 is placed in an inclined position with the nozzle 13 pointing downward and the supply port 14 facing upward, so that the molten metal in the liquid phase state in the heating cylinder 11 flows down into the front chamber due to self-weight.

The screw 12 is of a typical known type, and a back-flow preventing ring valve 15 is fitted into the outer circumference of the top end portion shaped in a cone in such a manner that it is allowed to move forward and backward. The screw 12 does not have a compressing section, and is formed in such a manner that flights are formed in spiral on the periphery of the axis portion having a constant diameter so that screw grooves at predetermined pitches are formed between the adjacent flights, by which the granular metal material supplied from the supply port 14 is transferred toward the head of the heating cylinder 11 by means of rotation of the screw 12.

Figure 3A:
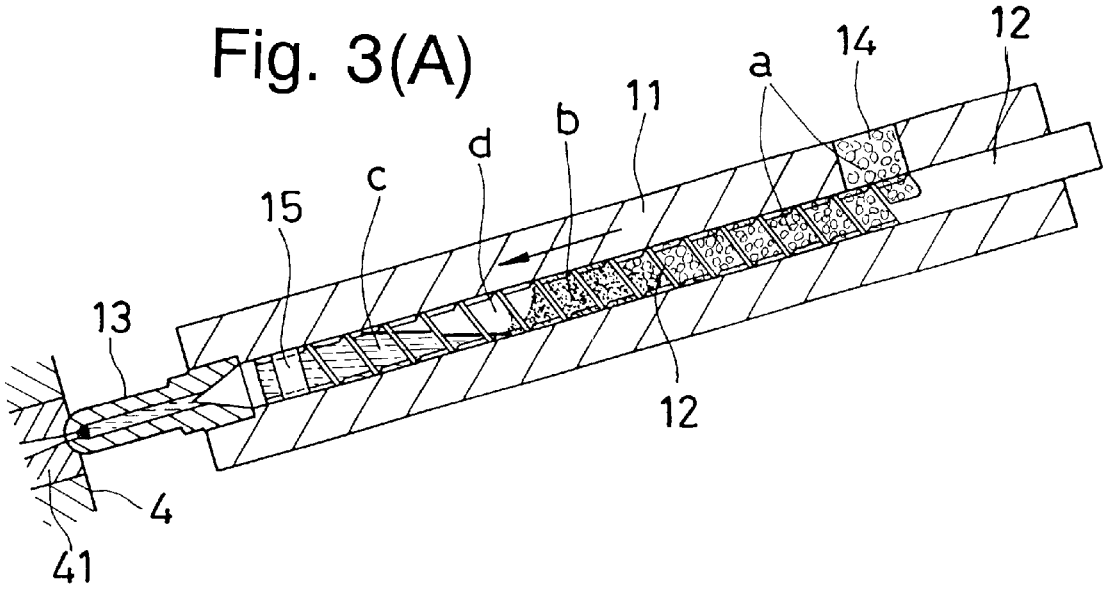
FIGS. 3(A) and 3(B) are explanatory views showing the steps of an injection molding method of a metal material of the present invention.
Figure 3B:
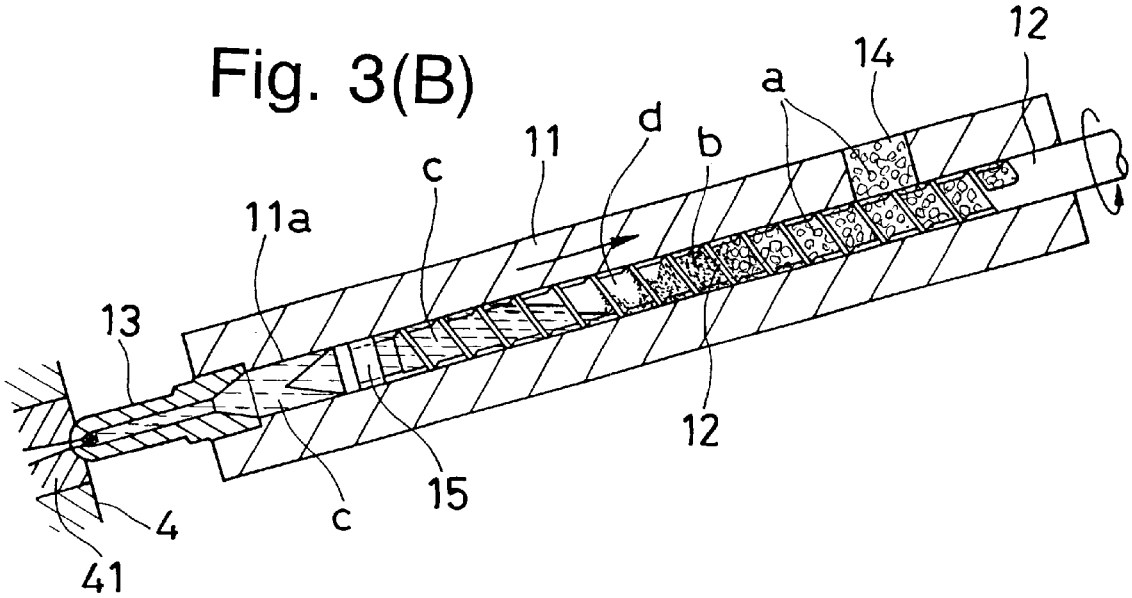

The injection apparatus 1 and clamping apparatus 2 are placed on an apparatus platform 3 in an inclined position at the same angle (inclination angle of at least 3 degrees) with the molds 4 at the lower end, so that the metal material in the liquid phase state in the heating cylinder 11 flows down into a front chamber 11*a* (See FIG. 3(B))of the heating cylinder 11 due to self weight, and that the nozzle 13 and a sprue bush 41 inside the mold 4 are positioned on the same straight line X—X, thereby maintaining the nozzle touch without bending the nozzle 13.

FIG. 3(A) is a view schematically showing the molten state of the metal material at the forward position of the screw 12 after injection. Here, the metal material turns from a granular material a to a semi-molten material b and to a liquid phase material c from the rear to the head. Initially, the metal material in the form of the granular material a is guided successively by the screw 12 and transferred toward the head of the heating cylinder 11 by means of rotation of the screw 12 during metering. On the way to the head, the granular material a starts to melt by heating from the external and turns to the semi-molten material b in the mixed state having both the solid phase and liquid phase.

When heated further, the liquid phase ratio in the semi-molten material b increases and only the liquid phase material c having a viscosity as low as that of hot water is readily collected below the screw 12 due to self-weight. However, in addition to a transfer effect attained by rotation of the screw 12, because the heating cylinder 11 is inclined with its head pointing downward and so is the screw 12, the liquid phase material c flows down on the periphery of the head portion of the screw 12 and is accumulated so as to increase its depth. Also, deaeration is conducted spontaneously due to its large specific gravity.

FIG. 3(B) shows a state when the liquid phase material c stored on the periphery of the head portion of the screw 12 is metered by supplying the same forcibly into the front chamber 11*a* of the heating cylinder 11. The metering is conducted by forcing the screw 12 at the forward position after injection to retract for a set distance with rotation while maintaining the nozzle touch between the nozzle 13 and sprue bush 41 inside the mold 4. In order to prevent the retraction of the screw 12 during rotation, it is preferable to apply a back pressure to some extent while the screw 12 is rotating.

By this rotational retraction, the liquid phase material c stored primarily on the periphery of the head portion of the screw 12 pushes open the closed ring valve 15 and flows into the front chamber 11*a*, whereby a predetermined quantity of the liquid phase material c is accumulated therein.

Also, by this rotation, the granular material a supplied from the supply port 14 at the rear portion of the screw 12 is transferred toward the head and turns into the semi-molten state by heating from the external. In addition, the semi-molten material b in the head is further melted while being transferred with heating, and turns into the liquid phase state. Consequently, the molten metal material is additionally stored on the periphery of the head portion of the screw 12, thereby increasing the accumulation quantity of the liquid phase material c. In addition, if there is a shortage in the liquid phase material c accumulated in the front chamber 11*a*, the shortage is compensated, so that metering can be conducted in a stable manner each time. Further, deaeration can be conducted smoothly due to self-weight of the material.

At the interface between the semi-molten material b and liquid phase material c, a gaseous phase d is produced. Because the semi-molten material b is positioned higher than the liquid surface that faces the gaseous phase d in a horizontal position, even when the liquid phase material c is allowed to stand by stopping the rotation of the screw 12, the liquid phase material c does not leak to the semi-molten material b side, thereby preventing unwanted variance in an accumulation quantity in the front chamber 11*a*.

A primarily accumulation quantity of the liquid phase material c varies with the number of revolutions (rpm) of the screw 12 and a rotation time (sec). Therefore, it is preferable to control the number of revolutions (rpm) of the screw 12 to stay at a set number of revolutions by counting the number of revolutions of the screw 12 by means of a sensor. More specifically, a predetermined number of revolutions since the rotation of the screw 12 started is counted by a revolution counter (sensor) employed in a typical molding apparatus, and the number of revolutions is found by computing the number of revolutions (rpm) of the screw 12 multiplied by a rotation time (sec), so as to control the number of revolutions of the screw 12 to stay at the set number of revolutions.

In order to prevent the retraction of the screw 12 during rotation, it is preferable to apply a back pressure to some extent while the screw 12 is rotating.

When the metering by means of rotation and retraction of the screw 12 is completed, the rotation of the screw 12 is stopped, and the step is switched to the injecting step. Then, the liquid phase material c metered in the front chamber 11*a* is injected into the molds 4 by moving the screw 12 forward. The cooled and solidified material used for the preceding injection is clogging the tip of the nozzle 13, but it is pushed out into the molds 4 by an injecting pressure at the injection. Therefore, this solidified material does not cause any trouble when injecting and filling the liquid phase material c accumulated in the front chamber 11*a*. In this manner, the screw 12 moves and reaches the forward position shown in FIG. 3(A), whereupon injection is completed. Then, the step is switched back to the metering step for the following metering, and the screw 12 is forced to retract to the set position with rotation.

In case of molded products each requiring a small injection quantity, a series of shots can be conducted at one time by setting a primarily accumulation quantity of the liquid phase material c to a large value. In this case, the screw 12 does not have to be rotated for each shot, but for each series of shots.

Figure 4:
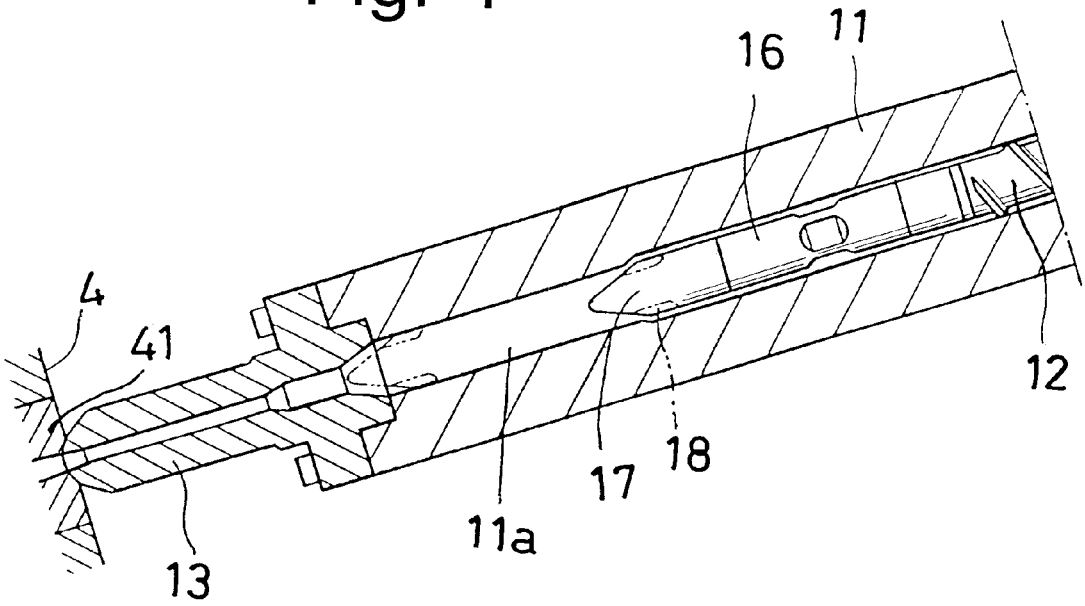
FIG. 4 is a longitudinal section of a top end portion of an injection apparatus equipped with a screw omitting a ring valve in accordance with another embodiment according to the present invention.

FIG. 4 shows another embodiment of an injection apparatus provided with a screw 12 omitting the ring valve 15 and instead including an injecting plunger at the tip.

In a heating cylinder 11 of this injection apparatus, a metering front chamber 11*a* is formed by reducing the inner diameter of the top end portion for a requirement length by 8 to 15% with respect to the inner diameter of the heating cylinder 11. It should be appreciated that the heating cylinder 11 includes a nozzle 13 at the tip in the same manner as the above embodiment.

The screw 12, which is housed in the heating cylinder 11 and allowed to rotate and move along the axial direction, is equipped with an injecting plunger 16 at the tip. The diameter of the plunger 16 is substantially the same as the diameter of the front chamber 11*a*. According to this arrangement, the plunger 16 is allowed to fit into the front chamber 11*a* by moving forward and backward while securing a sliding clearance such that hardly causes a back flow of the liquid phase material c accumulated in the front chamber 11*a*.

Also, a top end portion 17 of the plunger 16 is shaped in a cone with a tapered surface so as to fit into a funnel of the top end portion of the front chamber 11*a*. A plurality of concave channel grooves 18 are provided at regular intervals across the tapered surface and the head portion of the axis portion. The channel grooves 18 are not essential, and can be omitted if the retraction position of the screw 12 is set behind the one illustrated in the drawing and a channel space is formed on the periphery of the top end portion 17.

The screw 12 moves forward in the front chamber 11*a* until the top end portion 17 of the plunger 16 reaches the filling completion position by means of process control, and a full quantity of the liquid phase material c metered in the front chamber 11*a*, except for a required amount of the liquid phase material c used as a cushion, is injected to fill a pair of molds 4.

The metering of the material after the injection is conducted by forcing the screw 12 at the forward position after injection to retract for a set distance with rotation while maintaining the nozzle touch between the nozzle 13 and sprue bush 41 inside the mold 4.

Because the tip of the nozzle 13 is clogged with the cooled and solidified material used for the preceding injection, this retraction of the screw 12 produces a negative pressure state (decompressed or vacuum state) in the front chamber 11*a* of the heating cylinder 11. Hence, the liquid phase material c stored primarily on the periphery of the head portion of the screw 12 flows into the front chamber 11*a* by suction to be accumulated therein. The steps thereafter are the same as those in the above embodiment explained with reference to FIG. 3(B), and the detailed description of these steps is omitted for ease of explanation.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An injection molding apparatus for a metal material in a liquid phase state, comprising:

a unified injection apparatus comprising a single heating cylinder provided with a nozzle at a tip thereof and a supply port of a granular metal material at a rear portion thereof, a screw disposed inside said heating cylinder, said screw operative to rotate and move along an axial direction, and a front chamber inside said heating cylinder abutting said nozzle;

a mold;

a sprue bush disposed inside said mold;

a clamping apparatus provided to clamp said mold in opposition to said injection apparatus at said tip;

wherein said injection apparatus and clamping apparatus are placed on an apparatus platform in an inclined position at a same angle with said mold at a lower end, so that the metal material in a liquid phase state in said heating cylinder flows down into said front chamber of said heating cylinder due to self-weight, wherein said screw is operative to push the metal material in the liquid phase state from said front chamber into said nozzle during forward movement of said screw, the granular metal material becoming liquid during passage from a rear to a front of the screw; and wherein said nozzle and said sprue bush inside said mold are positioned on a same straight line, thereby maintaining contact of said nozzle without bending said nozzle.

2. The injection molding apparatus of a metal material according to claim 1, wherein:

said screw includes an injecting plunger at the tip thereof; and said injecting plunger has substantially a same diameter as a diameter of said front chamber formed in said heating cylinder at a top end portion, said diameter of said injecting plunger sized sufficiently to allow said injecting plunger to move forward and backward within said front chamber while securing a sliding clearance such that a back flow of the liquid phase material accumulated in said front chamber does not occur.

3. An injection molding method of a metal material in a liquid phase state comprising:

providing both (1) an injection apparatus comprising a single heating cylinder provided with a nozzle at a tip thereof and a supply port at a rear portion thereof, a screw disposed within said heating cylinder, said screw operative to rotate and move along an axial direction, and a front chamber inside said heating cylinder abutting said nozzle and (2) a mold, a sprue bush provided inside said mold;

placing said mold and said injection apparatus in opposition with a lower end of said injection apparatus in an inclined position at a same angle with said mold, so that the metal material in the liquid phase state in said heated cylinder flows down into said front chamber of said heating cylinder due to self weight;

accumulating and metering the metal material in the liquid phase state in said front chamber of said heating cylinder by flowing due to inclination and rotation of said screw; and injecting the metal material in the liquid phase state to fill said mold by moving said screw forward.

4. A metering method employed in the injection molding method of metal material in liquid phase state according to claim 3, wherein a sensor for counting a number of revolutions of said screw is provided, and the number of revolutions of said screw is controlled to stay at a set number of revolutions between successive injections by said sensor.

* * * * *